US011542694B2

(12) United States Patent
Allen et al.

(10) Patent No.: US 11,542,694 B2
(45) Date of Patent: Jan. 3, 2023

(54) ELECTRICAL CONNECTION FOR ELECTRONIC FAUCET ASSEMBLY

(71) Applicant: Delta Faucet Company, Indianapolis, IN (US)

(72) Inventors: Benjamin Michael Allen, Carmel, IN (US); Joel Sawaski, Indianapolis, IN (US); Bennett Jay Carter, Indianapolis, IN (US)

(73) Assignee: Delta Faucet Company, Indianapolis, IN (US)

( * ) Notice: Subject to any disclaimer, the term of this patent is extended or adjusted under 35 U.S.C. 154(b) by 52 days.

(21) Appl. No.: 17/323,309

(22) Filed: May 18, 2021

(65) Prior Publication Data

US 2022/0372740 A1 Nov. 24, 2022

(51) Int. Cl.
*E03C 1/05* (2006.01)
*H01R 4/48* (2006.01)

(52) U.S. Cl.
CPC ..... *E03C 1/057* (2013.01); *H01R 4/48* (2013.01)

(58) Field of Classification Search
CPC ..... E03C 1/057
USPC ..... 4/675, 678, 567
See application file for complete search history.

(56) References Cited

U.S. PATENT DOCUMENTS 4,934,960 A 6/1990 Capp et al.
6,467,651 B1 * 10/2002 Muderlak ..... A61L 9/145 222/63
6,853,337 B2 2/2005 Barabash
6,962,168 B2 11/2005 McDaniel et al.
7,458,520 B2 12/2008 Belz et al.
7,690,395 B2 4/2010 Jonte et al.
(Continued)

FOREIGN PATENT DOCUMENTS

CA 2932972 A1 * 1/2017 ..... E03C 1/0401
CN 104089065 A 10/2014
(Continued)

OTHER PUBLICATIONS

Delta Faucet Company, Quick Tips for your Delta® Touch2O® Technology Kitchen Faucet, Mar. 23, 2016, 60 pages.
(Continued)

*Primary Examiner* — Lori L Baker
(74) *Attorney, Agent, or Firm* — Bose McKinney & Evans LLP

(57) ABSTRACT

An electronic faucet assembly having a faucet body and a mounting shank. At least one electrically controlled valve is disposed in a fluid line between the fluid supply and a fluid passageway supported by the faucet body. A controller is configured to control operation of the valve. A circuit component supported on the faucet body is in electrical communication with a proximal portion of the mounting shank. A spring clip in electrical communication with the control circuit is mounted on a smooth cylindrical surface of the distal portion of the mounting shank. The mounting shank may be aluminum with an aluminum oxide layer on the smooth cylindrical surface. Electrical signals may be conducted between the spring clip and mounting shank by capacitive coupling without conduction of electrical current between the spring clip and mounting shank. The spring clip may be dimensioned to prevent incorrect installation on the mounting shank.

30 Claims, 9 Drawing Sheets

(56) References Cited

U.S. PATENT DOCUMENTS

| | | | | |
|---|---|---|---|---|
| 7,997,301 | B2 | 8/2011 | Marty et al. | |
| 8,376,313 | B2 | 2/2013 | Burke et al. | |
| 8,424,569 | B2 | 4/2013 | Marty et al. | |
| 8,469,056 | B2 | 6/2013 | Marty et al. | |
| 8,528,579 | B2 | 9/2013 | Jonte et al. | |
| 8,561,626 | B2 | 10/2013 | Sawaski et al. | |
| 8,613,419 | B2 | 12/2013 | Rodenbeck et al. | |
| 8,776,817 | B2 | 7/2014 | Sawaski et al. | |
| 8,844,564 | B2 | 9/2014 | Jonte et al. | |
| 8,939,429 | B2 | 1/2015 | Sawaski et al. | |
| 8,944,105 | B2 | 2/2015 | Rodenbeck et al. | |
| 8,973,612 | B2 | 3/2015 | Sawaski et al. | |
| 9,057,184 | B2 | 6/2015 | Meehan et al. | |
| 9,074,357 | B2 | 7/2015 | Meehan et al. | |
| 9,163,972 | B2 | 10/2015 | Veros et al. | |
| 9,175,458 | B2 | 11/2015 | Meehan et al. | |
| 9,187,884 | B2 | 11/2015 | Belz et al. | |
| 9,243,390 | B2 | 1/2016 | Rosko et al. | |
| 9,243,391 | B2 | 1/2016 | Jonte et al. | |
| 9,243,392 | B2 | 1/2016 | Marty et al. | |
| 9,315,976 | B2 | 4/2016 | Rodenbeck et al. | |
| 9,333,698 | B2 | 5/2016 | DeVries et al. | |
| 9,394,675 | B2 | 7/2016 | Sawaski et al. | |
| 9,603,493 | B2 | 3/2017 | Veros et al. | |
| 9,797,119 | B2 | 10/2017 | Belz et al. | |
| 9,976,291 | B2 | 5/2018 | Sawaski et al. | |
| 10,081,930 | B1 | 9/2018 | Zhuo et al. | |
| 10,227,759 | B2 | 3/2019 | Li et al. | |
| 2002/0185500 | A1* | 12/2002 | Muderlak | A47K 5/1217 222/1 |
| 2009/0101679 | A1* | 4/2009 | Muderlak | A47K 5/16 222/375 |
| 2013/0014844 | A1* | 1/2013 | Davidson | F16K 31/02 137/625.41 |
| 2014/0116553 | A1* | 5/2014 | Schoolcraft | E03C 1/057 137/801 |
| 2015/0013064 | A1* | 1/2015 | Marty | H01C 1/14 4/668 |
| 2016/0362877 | A1 | 12/2016 | Thomas et al. | |
| 2017/0016216 | A1* | 1/2017 | Crowe | F16L 37/088 |
| 2020/0024837 | A1* | 1/2020 | Wales | G05D 23/1306 |
| 2020/0299941 | A1 | 9/2020 | Veros et al. | |

FOREIGN PATENT DOCUMENTS

| | | | | |
|---|---|---|---|---|
| WO | 2007082301 | A2 | 7/2007 | |
| WO | WO-2008088534 | A2 * | 7/2008 | E03C 1/05 |

OTHER PUBLICATIONS

Bradley Corporation, Aerada™ 1200 Series CS Faucet, Jul. 6, 2010, 7 pages.

Delta Faucet Company, Delta 631TP3x0 Installation and Setup, Sep. 2015, 18 pages.

Grohe, Grohe Minta Touch installation manual (USA), Jun. 12, 2013, 19 pages.

Matt Weber, Diy Installing a Touch-Activated Kitchen Faucet, Jul. 30, 2010, 8 pages.

Delta Faucet Company, Touch2O Pull-Out Kitchen & Bar/Prep Faucet, 92834, Apr. 11, 2018, 20 pages.

* cited by examiner

ELECTRICAL CONNECTION FOR ELECTRONIC FAUCET ASSEMBLY

BACKGROUND AND SUMMARY

The present invention relates to electronic faucet assemblies which communicate electrical signals during operation of the faucet and an electrical connection for facilitating the communication of electrical signals in such an assembly.

Electronic faucets are known in the art for controlling fluid flow. Some electronic faucets may include proximity sensors such as active infrared (IR) proximity detectors or capacitive proximity sensors to control operation of the faucet. Such proximity sensors are typically used to detect a user's hands positioned near the faucet and automatically start fluid flow through the faucet in response to detection of the user's hands. Other electronic faucets may use touch sensors to control the faucet. Such touch sensors may include capacitive touch sensors or other types of touch sensors located on a spout or on a handle of the faucet for controlling operation of the faucet. Electronic faucets may also include separate touch and proximity sensors and various other electrical circuit components useful in the operation of the electronic faucet.

Such electronic faucets will often require an electrical connection between the a control circuit and the physical structure of the faucet assembly to facilitate the communication of electrical signals.

The present disclosure provides an electrical connection assembly that facilitates the communication of electrical signals in a faucet assembly and which represents an improvement over the known art.

According to an illustrative embodiment of the present invention, an electronic faucet assembly configured to be mounted on a support structure and coupled to a fluid supply includes a faucet body; a fluid passageway supported by the faucet body; a mounting shank mechanically coupled to the faucet body and configured to extend through the support structure, the mounting shank having a proximal portion disposed proximate the faucet body and a distal portion spaced from the proximal portion; at least one electrically controlled valve disposed in a fluid line between the fluid supply and the fluid passageway; a control circuit in communication with the at least one electrically controlled valve, the control circuit including a controller configured to control operation of the at least one electrically controlled valve; a circuit component in electrical communication with the proximal portion of the mounting shank; a spring clip mounted on the distal portion of the mounting shank with the spring clip being in electrical communication with the control circuit; and wherein the mounting shank is formed of an aluminum material and the distal portion of the mounting shank includes an exterior surface defining a smooth cylindrical surface and wherein the spring clip is mounted on the smooth cylindrical surface of the mounting shank with the spring clip biasingly engaging and encircling greater than half of an outer circumference of the smooth cylindrical surface such that electrical signals communicated between the circuit component and the control circuit are communicated through the mounting shank and the spring clip.

According to another illustrative embodiment of the present invention, an electronic faucet assembly configured to be mounted on a support structure and coupled to a fluid supply includes a faucet body; a fluid passageway supported by the faucet body; a mounting shank mechanically coupled to the faucet body and configured to extend through the support structure, the mounting shank having a proximal portion disposed proximate the faucet body and a distal portion spaced from the proximal portion; at least one electrically controlled valve disposed in a fluid line between the fluid supply and the fluid passageway; a control circuit in communication with the at least one electrically controlled valve, the control circuit including a controller configured to control operation of the at least one electrically controlled valve; a circuit component in electrical communication with the proximal portion of the mounting shank; a spring clip mounted on the distal portion of the mounting shank, the spring clip being in electrical communication with the control circuit; and wherein the mounting shank is formed of an electrically conductive metal material and the distal portion of the mounting shank includes an exterior surface defining a smooth cylindrical surface and wherein a layer of non-conductive material covers the smooth cylindrical surface and wherein the spring clip is mounted on the smooth cylindrical surface of the mounting shank with the spring clip biasingly engaging and encircling greater than half of an outer circumference of the smooth cylindrical surface such that electrical signals communicated between the circuit component and the control circuit are communicated through the mounting shank and the spring clip and wherein the communication of the electrical signals between the distal portion of the mounting shank and the spring clip is by capacitive coupling without conduction of electrical current between the mounting shank and the spring clip.

According to yet another illustrative embodiment of the present invention, an electrical connection assembly for an electronic faucet assembly having a faucet body configured to be mounted on a support structure and a control circuit with a circuit component includes: a mounting shank mechanically coupled to the faucet body and configured to extend through the support structure, the mounting shank having a proximal portion disposed proximate the faucet body and a distal portion spaced from the proximal portion; and a spring clip adapted to be in electrical communication with the control circuit, the spring clip being formed by a conductive metal sheet material which defines a circumferential collar that encircles a central axis, the collar having a first end portion and an opposite second end portion, the first end portion defining a radially outwardly extending first grip and the second end portion defining a radially outwardly extending second grip, the circumferential collar extending for greater than 360 degrees about the central axis to thereby define an overlapping zone between the first and second grips wherein both the first end portion and the second end portion are disposed, and wherein, in a relaxed state, the spring clip defines a minimum inner diameter of the spring clip and wherein biasing the first and second grips toward each other increases the inner diameter of the spring clip, the first end portion defining a first stop member and the second end portion defining a second stop member engagement of the first and second stop members preventing further movement of the first and second grips toward each other and defining a biased open state wherein the spring clip defines a maximum inner diameter of the spring clip; wherein the mounting shank is formed of an electrically conductive metal material and the distal portion of the mounting shank includes an exterior surface defining a smooth cylindrical surface and wherein the spring clip is mounted on the smooth cylindrical surface of the mounting shank with the spring clip biasingly engaging and encircling an outer circumference of the smooth cylindrical surface such that electrical signals communicated between the circuit component and the control circuit are communicated through the mounting shank and the spring clip; and wherein the mounting shank defines a first outer diameter between the proximal portion of the mounting shank and the smooth cylindrical surface, the smooth cylindrical portion defining a second diameter smaller than the first diameter and wherein the second diameter is at least as great as the minimum inner diameter of the spring clip and the first diameter is greater than the maximum inner diameter of the spring clip.

According to still another illustrative embodiment of the present invention, an electronic faucet assembly configured to be mounted on a support structure and coupled to a fluid supply includes a faucet body; a fluid passageway supported by the faucet body; a mounting shank mechanically coupled to the faucet body and configured to extend through the support structure, the mounting shank having a proximal portion disposed proximate the spout and a distal portion spaced from the proximal portion; at least one electrically controlled valve disposed in a fluid line between the fluid supply and the fluid passageway; a control circuit in communication with the at least one electrically controlled valve, the control circuit including a controller configured to control operation of the at least one electrically controlled valve; a circuit component in electrical communication with the proximal portion of the mounting shank; a spring clip in electrical communication with the control circuit, the spring clip being formed by a conductive metal sheet material which defines a circumferential collar that encircles a central axis, the collar having a first end portion and an opposite second end portion, the first end portion defining a radially outwardly extending first grip and the second end portion defining a radially outwardly extending second grip, the circumferential collar extending for greater than 360 degrees about the central axis to thereby define an overlapping zone between the first and second grips wherein both the first end portion and the second end portion are disposed, and wherein, in a relaxed state, the spring clip defines a minimum inner diameter of the spring clip and wherein biasing the first and second grips toward each other increases the inner diameter of the spring clip, the first end portion defining a first stop member and the second end portion defining a second stop member engagement of the first and second stop members preventing further movement of the first and second grips toward each other and defining a biased open state wherein the spring clip defines a maximum inner diameter of the spring clip; wherein the mounting shank is formed of an electrically conductive metal material and the distal portion of the mounting shank includes an exterior surface defining a smooth cylindrical surface and wherein the spring clip is mounted on the smooth cylindrical surface of the mounting shank with the spring clip biasingly engaging and encircling an outer circumference of the smooth cylindrical surface such that electrical signals communicated between the circuit component and the control circuit are communicated through the mounting shank and the spring clip; and wherein the mounting shank defines a first outer diameter between the proximal portion of the mounting shank and the smooth cylindrical surface, the smooth cylindrical portion defining a second diameter smaller than the first diameter and wherein the second diameter is at least as great as the minimum inner diameter of the spring clip and the first diameter is greater than the maximum inner diameter of the spring clip.

BRIEF DESCRIPTION OF THE DRAWINGS

The above mentioned and other features of this invention, and the manner of attaining them, will become more apparent and the invention itself will be better understood by reference to the following description of embodiments of the invention taken in conjunction with the accompanying drawings, wherein.

Figure 1:
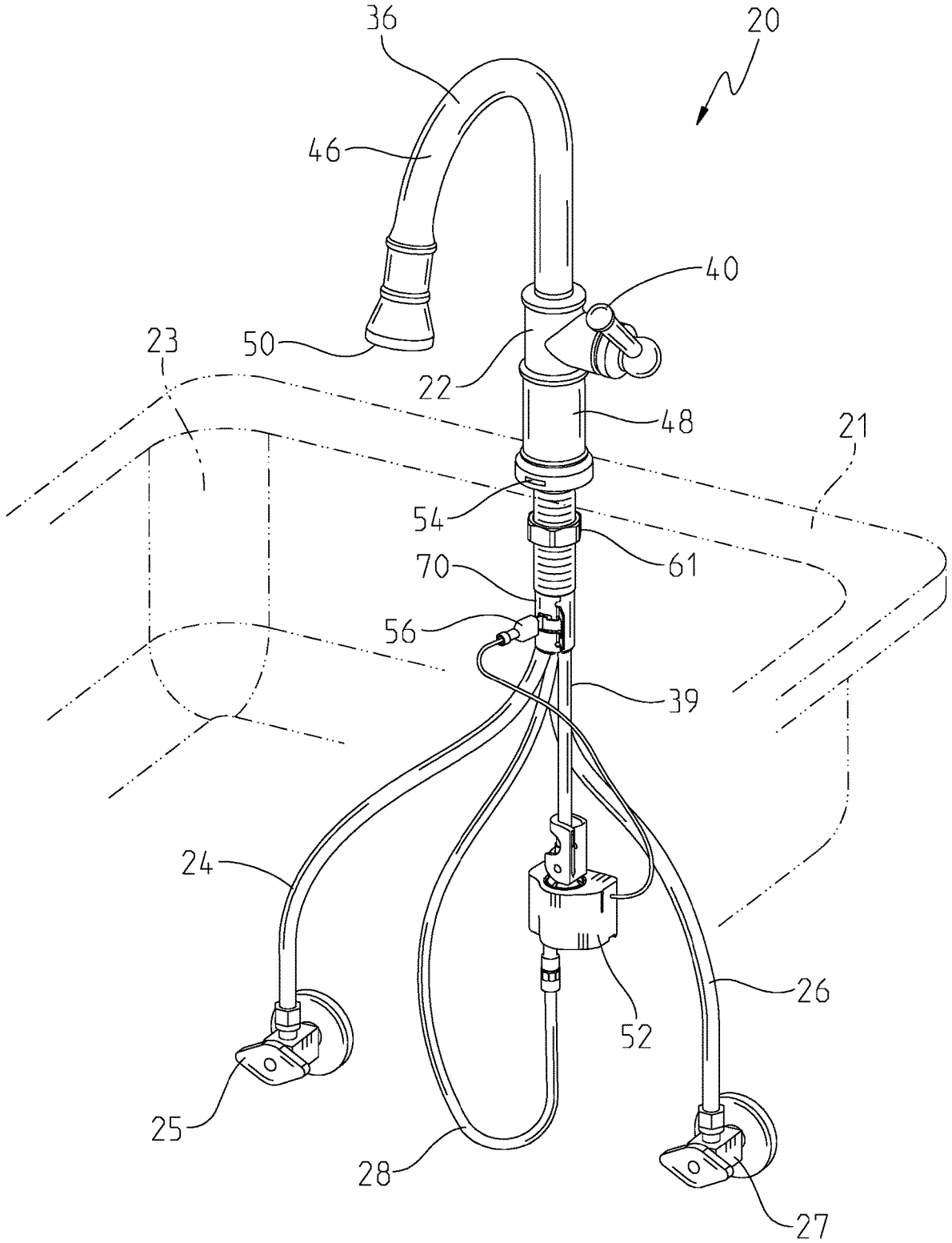
FIG. 1 is a perspective view of an electronic faucet assembly.

Corresponding reference characters indicate corresponding parts throughout the several views. Although the exemplification set out herein illustrates several embodiments of the invention, the embodiments disclosed below is not intended to be exhaustive or to be construed as limiting the scope of the invention to the precise form disclosed.

DETAILED DESCRIPTION

Figure 2:
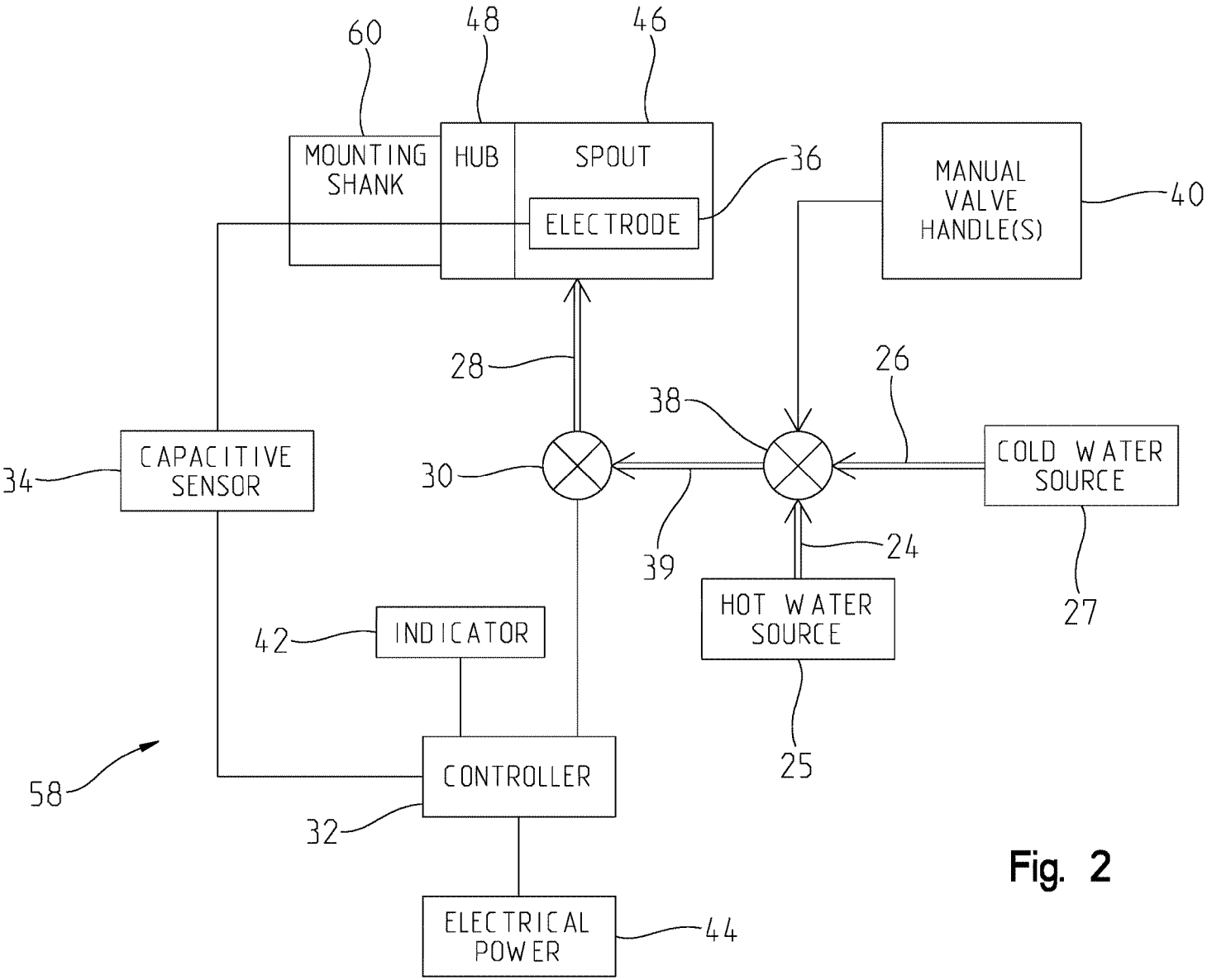
FIG. 2 is a schematic diagram of the faucet assembly of FIG. 1.
Figure 3:
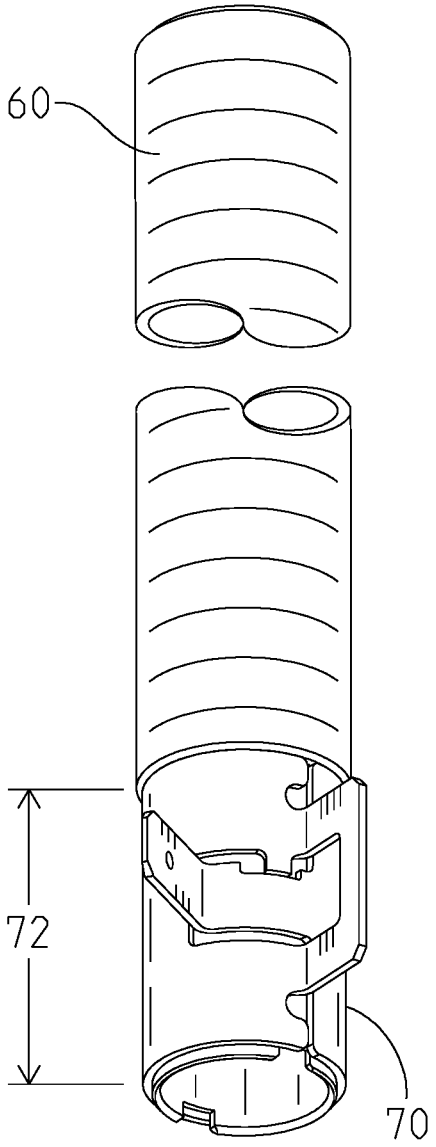
FIG. 3 is a perspective view of a mounting shank with a spring clip mounted thereon.
Figure 4:
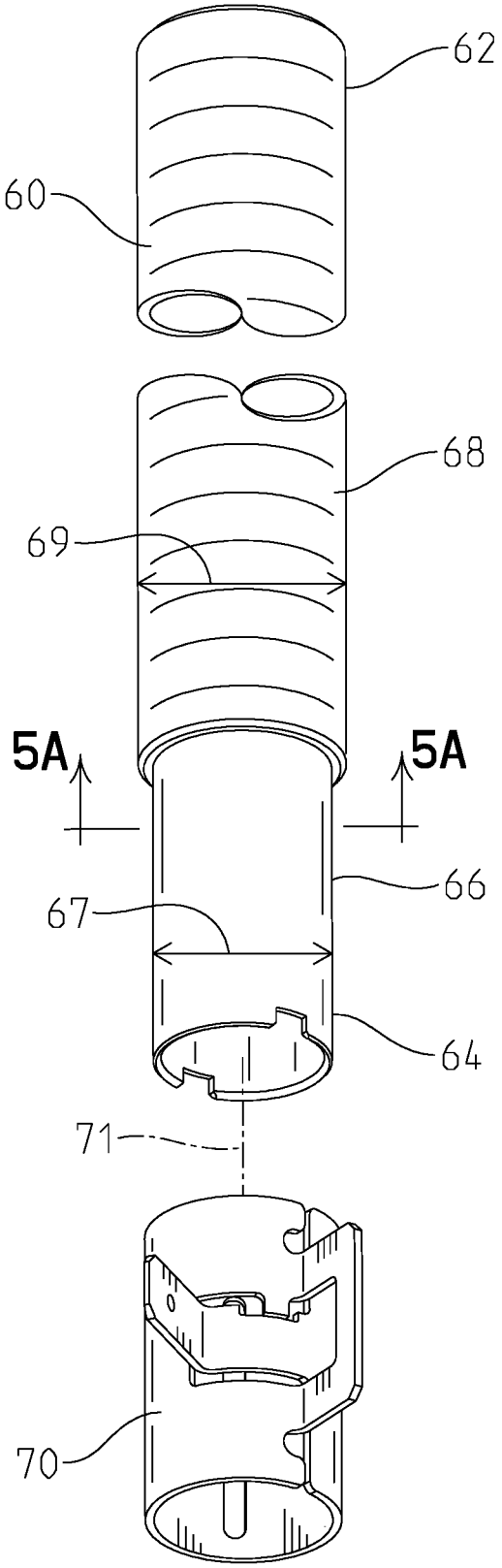
FIG. 4 is an explode perspective view of the mounting shank and spring clip of FIG. 3.
Figure 5A:
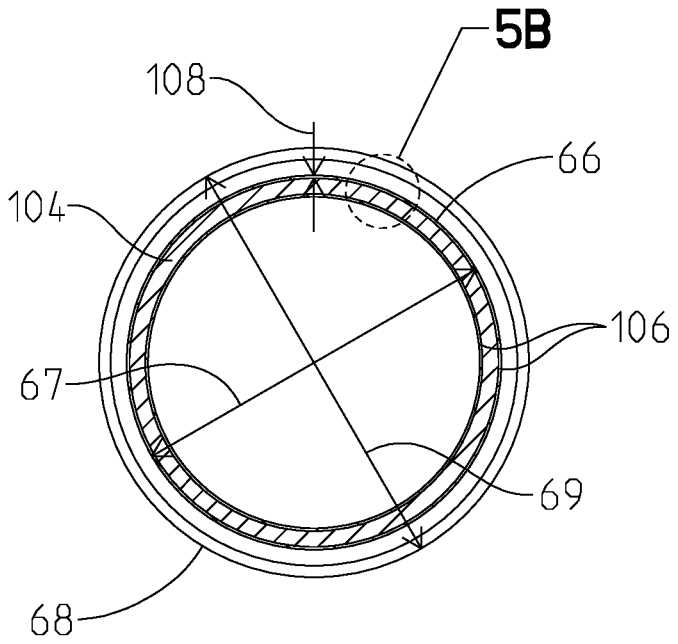
FIG. 5A is a cross sectional view taken along line 5A-5A of FIG. 4.
Figure 5B:
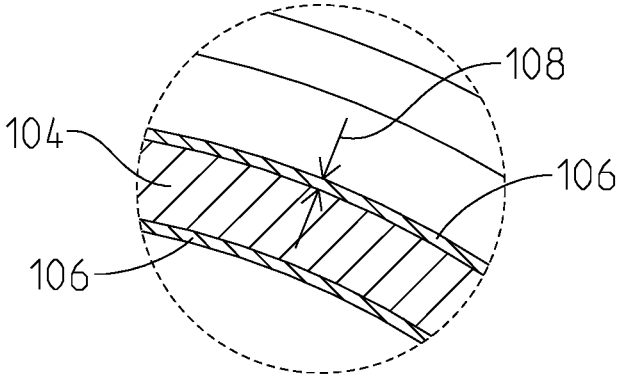
FIG. 5B is a detail view of FIG. 5A.

An electronic faucet assembly 20 is shown in FIGS. 1 and 2. Faucet assembly 20 includes a faucet body 22 which supports a fluid passageway 28 for delivering fluids, for example, water. In the illustrated embodiment, faucet assembly 20 includes a fluid conduit 24 for hot water, a fluid conduit 26 for cold water and a fluid conduit 28 for the output water. Hot water conduit 24 connects a hot water source 25 to a valve assembly 38 and cold water conduit 26 connects a cold water source 27 to valve assembly 38. Intermediate fluid conduit 39 connects valve assembly 38 with solenoid valve 30. Output conduit 28 extends from solenoid valve 30 to the point of discharge of faucet body 22.

Solenoid valve 30 is controlled electrically by controller 32. In the illustrated embodiment, controller 32 is configured to open and close solenoid valve 30 to thereby turn on and off the fluid flow to spout 22. In alternative embodiments, controller 24 can be further configured to proportionally control solenoid valve 22 to adjust the flow rate of the fluid flowing through spout 22. In the illustrated embodiment, solenoid valve 22 is a pilot operated solenoid valve, however, electrically operable or actuator driven valves may alternatively be used. An example of suitable controller and solenoid valve are described in U.S. Pub. No. 2016/0362877 A1, the disclosure of which is expressly incorporated herein by reference.

Controller 32 is disposed in control circuit 58 which is also in electrical communication with electrically operable valve 30, capacitive sensor 34, electrode 36 and indicator 42. Controller 32 controls the opening and closing of solenoid valve 30 based on the output of at least one sensor, such as a proximity sensor and/or a touch sensor. In the illustrated embodiment, a capacitive sensor 34 is in communication with controller 32 to provide signals to controller 32 indicating the detection of an object, such as a user's hand, on or near faucet body 22. In this exemplary embodiment, an electrode 36 of capacitive sensor 34 is coupled to faucet body 22 to detect the object. Electrode 36 may also be positioned at alternative positions on faucet assembly 20 for the detecting the presence of the object, e.g., a user's hand.

Faucet 20 is shown supported by a conventional support structure 21, such as a countertop or a sink deck above a basin or sink 23. The illustrative electronic faucet 20 includes an upper faucet body having a spout 46 supported by a hub 48 which is mounted on the sink deck 21. The spout 46 supports a water outlet 50 for dispensing water into the sink basin 23. Spout 46 is rotatable relative to hub 48 about a vertical axis whereby the position of water outlet 50 above sink basin 23 can be adjusted. The water outlet 50 may be defined by a conventional aerator supported within a pullout wand, however, alternative configurations may also be used. The spout 46 is illustratively formed of an electrically conductive material, such as a die-cast zinc, brass or a chrome plated polymer.

Manual valve is 38 is illustratively supported by the hub 48 and is fluidly coupled to hot water source 25 and cold water source 27. The hot water source 25 and cold water source 27 may be defined by conventional water valve stops with a flexible hot water inlet tube 24 fluidly coupling the hot water source 25 to the manual valve 38, and a flexible cold water inlet tube 26 fluidly coupling the cold water source 27 to the manual valve 38. In an illustrative embodiment, electrically operable solenoid valve 30 is fluidly coupled in series with, and downstream from, the manual valve 38. The electrically operable valve 30 is illustratively part of a control unit 52. Illustrative control unit 52 includes a housing in which valve 30, controller 32, capacitive sensor 34 and an electrical power supply 44 in the form of a battery are housed.

While the illustrated embodiment utilizes an electrical power supply 44 in the form of a battery, or other direct current (DC) power supplies could be employed. Alternatively, controller 32 may include an electrical power cord for plugging into a wall outlet or alternating current (AC) power supply for supplying electrical power to faucet assembly 20. In such an embodiment, the power cord would also include a rectifier to convert the AC electrical current to a DC electrical current of an appropriate voltage and amperage.

Intermediate conduit 39 between the two valves 30, 38 may take the form of a flexible connecting tube. Output conduit 28 defines a fluid passageway fluidly coupling the electrically operable valve 30 to the water outlet 50. Output conduit may be a flexible tube slidably received within hub 48 and spout 46. The tubes 24, 26, 28 and 39 may be formed of a polymer, illustratively a cross-linked polyethylene (PEX) or other suitable material.

In the embodiment of FIG. 2, an externally threaded mounting shank 60 is mechanically coupled with faucet body 22 and extends downwardly from the faucet hub 48. A mounting nut 61 is threadably secured to mounting shank 60 and secures faucet assembly 20 to the support structure 21. An insulator base 54 is illustratively positioned between faucet hub 48 and the mounting structure 21, e.g., a sink deck. Insulator base 54 is formed of an electrically insulating material, such as polymer, and may support an indicator light 42. Insulator base 54 electrically isolates faucet body 22 from the support structure 21.

In the illustrative embodiment, capacitive sensor 34 and electrode 36 are used for at least one of a touch mode and a hands-free mode of operation. In the touch mode of operation, capacitive sensor 34 is used to detect a user's hand or other object upon contact with a surface of faucet body 22. In the hands-free mode of operation, capacitive sensor 34 is used to detect a user's hand or other object within a detection zone near faucet body 22. For example, the detection zone may include the area into which a stream of water is discharged from spout 46 and the immediately surrounding area. In either mode, when the user's hand or other object is detected, electrically operable valve 30 is opened by controller 32 to initiate water flow through a fluid passageway in the form of output conduit 28 in the illustrated embodiment. Controller 32 subsequently causes valve 30 to close and thereby turn off the water flow. For example, in touch mode, the controller 32 may toggle the water flow both on and off in response to contact with spout 46. In the hands-free mode, controller 32 may toggle the water flow off after predefined period of time elapses after turning it on. Various other control schemes may also be used to determine when to toggle the water flow on and off. Controller 32 may also be configured to make logical decisions to control different modes of operation of faucet 20 such as changing between a manual mode of operation and an automated mode of operation such as a hands-free and/or touch mode of operation.

In the illustrated embodiment, manual operation of faucet assembly 20 is facilitated by manual valve handle 40 which is coupled to manual valve 38. In the exemplary faucet assembly, electrically operable valve 30 is downstream of manual valve assembly 38 and intermediate fluid conduit 39 conveys fluid from valve assembly 38 to electrically operable valve 30. Manual handle 40 allows the user to manually adjust the temperature and flow rate of the water being discharged from spout 46 after electrically operable valve 30 is opened and fluid is allowed to flow through output conduit 28. In the illustrated embodiment, a single handle 40 is provided and manipulates manual valve assembly 38 to adjust both the flow rate and relative proportion of fluid flow from hot water conduit 24 and cold water conduit 26. Alternative arrangements may also be used. For example, a separate manual valve could be provided for both the hot water conduit and the cold water conduit or faucet assembly 20 could be a fully automated faucet without any manual valve handles.

Faucet assembly 20 may also include a temperature sensor positioned to sense the temperature of the fluid being discharged from spout 46 and in communication with controller 32. Such a temperature sensor can be used to communicate the temperature of the water being discharged to the user as discussed below. Such a temperature sensor may also be used to provide feedback to the controller in a faucet system having an electrically controlled mixing valve instead of a strictly manual mixing valve assembly. In such a system, controller 32 can be used to control the mixing valve and thereby control the relative proportions of hot and cold water being used to generate the discharged fluid. Examples of such electrically controlled mixing valves are disclosed in U.S. Pat. No. 7,458,520 and PCT App. Serial No. PCT/US2007/060512, the disclosures of which are expressly incorporated herein by reference.

Faucet assembly 20 may also include one or more displays or indicators controlled by controller 32 to communicate information to the user of the faucet assembly either visually and/or audibly as represented by indicator 42 in FIG. 2. For example, indicator 42 may take the form of one or more light-emitting diodes (LEDs) to indicate the current operational mode of faucet assembly 20. Selective illumination of different colored LEDs or a single multi-colored LED may also be used to indicate the temperature of the fluid being dispensed by faucet assembly 20. Alternative indicators may also be used, for example, a liquid crystal display (LCD) could alternatively be controlled by controller 32 to communicate information to the user. Controller 24 may also be used to control various other accessories such as a remote dispensing device, for example, a soap dispenser.

Mounting shank 60 is mechanically coupled to faucet body 22 and extends through support structure 21. Proximal portion 62 of mounting shank is disposed proximate faucet body 22 and a circuit component 36 supported on faucet body 22 is in electrical communication with proximal portion 62 of mounting shank 60. For example, circuit component 36 may be the electrode, i.e., the sensing element of capacitive sensor 34. In the illustrated embodiment, spout 46 and hub 48 have exposed surfaces defined by an electrically conductive material and it is the exposed surfaces of spout 46 and hub 48 that define the sensing element 36 of capacitive sensor 34.

Distal portion 64 of mounting shank 60 is disposed opposite proximal portion 62 and has an exterior surface that defines a smooth cylindrical surface 66. An exterior helical thread 68 extends between proximal 62 and distal 64 portions of mounting shank 60. A spring clip 70 is mounted on the smooth cylindrical surface 66 of distal portion 64 of the mounting shank 60. Spring clip 70 biasingly engages and encircles greater than half of the outer circumference of smooth cylindrical surface 66. In the illustrated embodiments, spring clip 70 fully encircles smooth cylindrical surface 66. A spade connector 56 is coupled to spring clip 70 to provide electrical communication between spring clip 70 and control circuit 58. In the exemplary embodiments, spring clip 70 is formed out of a stainless steel material. Electrical signals communicated between circuit component 36 and control circuit 58 are communicated through the mounting shank 60 and spring clip 70.

Capactive sensor 34 is configured to detect when a person touches sensing element 36. More particularly, control circuit 58 applies an electrical potential to sensing element 36 through the spring clip 70 and mounting shank 60 and capacitive sensor 34 monitors the electrical signals conveyed between the spring clip 70 and mounting shank 60 to detect touching of the sensing element 36 by a user. As mentioned above, in the illustrated embodiment, spout 46 and hub 48 have exterior surfaces formed out of a conductive metal material and it is the exterior surfaces of spout 46 and hub 48 which form sensing element 36. The use of a capacitive sensor to detect the touching of an object by a user is well known to those having ordinary skill in the art.

The electrical potential applied to the sensing element 36 is advantageously no greater than 5V. The amperage used to apply the electrical potential is also minimal, e.g., less than 100 microamps and advantageously no more than 50 microamps or no more than 20 microamps. A minimal voltage is all that is required for operation of capacitive sensor 34 and the use of such a minimal voltage at a minimal amperage does not pose a danger to users of the faucet assembly 20.

The electrical signals communicated between mounting shank 60 and spring clip 70 are communicated by capacitive coupling without conduction of electrical current between the mounting shank 60 and spring clip 70. To provide this coupling, mounting shank 60 is formed out of an electrically conductive material 104 and has a layer of non-conductive material 106 covering the smooth cylindrical surface 66 on which spring clip 70 is mounted. In other words, an electromagnetic field created by an electrical current in spring clip 70 and/or electrically conductive material 104 of mounting shank 60 induces an electrical current in the other one of the spring clip 70 or conductive material 104 without conducting the electrical current across the non-conductive gap defined by non-conductive material 106.

In the illustrated embodiment, capacitive sensor 34 generates an AC electrical current having a voltage of no more than 5V which is communicated to spring clip 70 to thereby apply an electrical potential to faucet body 22 for purposes of detecting a user touching the faucet body. Other embodiments, however, could communicate electrical signals between mounting shank 60 and spring clip 70 for alternative purposes.

In the illustrative examples, mounting shank 60 is formed out of an aluminum material 104 and has a non-conductive layer of aluminum oxide 106 disposed thereon. The aluminum oxide layer 106 forms an annular non-conductive annular gap between electrically conductive material 104 of mounting shank 60 and the electrically conductive material forming spring clip 70. In the illustrated embodiments, spring clip 70 is formed out of stainless steel.

Although the exemplary shanks are formed out of an aluminum material, alternative conductive materials, such as brass or a conductive polymer could be used and have a coating of a non-conductive material, e.g., an epoxy, applied to the shank to provide the non-conductive surface layer on which the spring clip is mounted.

When using an aluminum material to form mounting shank 60, an aluminum oxide layer 106 can be formed on cylindrical surface 66 in various different manners. For example, a raw aluminum surface can simply be exposed to ambient air and it will naturally develop a layer of aluminum oxide upon being exposed to the ambient air.

The aluminum oxide layer on a raw aluminum surface exposed to ambient air will continue to grow over time but at a logarithmic scale wherein the initial thickness will peak at about 4 nm and then the rate of growth will progressively slow. For example, mounting shanks 60A, 60B shown in FIGS. 10 and 12 have smooth cylindrical surfaces 66A, 66B which are raw aluminum surfaces having an aluminum oxide layer with a thickness of no more than 10 nm.

Alternatively, the aluminum oxide layer disposed on smooth cylindrical surface 66 may be an anodized surface. For example, mounting shaft 60 is formed out of an aluminum material and subjected to a conventional anodizing process whereby all of the exposed surfaces of mounting shaft 60 are anodized surfaces including helical thread 68 and smooth cylindrical surface 66. An anodized surface will be formed by a non-conductive aluminum oxide layer similar to the aluminum oxide layer on a raw aluminum surface. However, the aluminum oxide layer of an anodized surface will generally be more dense and have a greater strength than an aluminum oxide layer which forms naturally on a raw aluminum surface. It will also generally have a much greater thickness. For example, a typical anodized surface will be formed by a layer of aluminum oxide having a thickness of at least about 1775 nm which is considerably greater than the aluminum oxide layer on a raw aluminum surface.

Because anodized surfaces provide a more durable product, illustrated mounting shanks 60A, 60B are formed out of an aluminum material that is then subjected to an anodizing process to produce an anodized surface on all of the exposed surfaces of mounting shanks 60A, 60B. After the anodizing process, a machining process is employed to remove the anodized surface from the distal portions of mounting shanks 60A, 60B and form smooth cylindrical surfaces 66A, 66B with each of these surfaces being raw aluminum surfaces while helical threads 68A, 68B retain their anodized surfaces.

Communicating electrical signals between mounting shank 60 and spring clip 70 depends, in part, on the size of the non-conductive gap which, in the illustrated embodiments, is formed by a layer of aluminum oxide. To maintain the same efficiency in transferring electrical signals, larger gaps can be combined with either an increase in the voltage of the electrical signals or an increase in the surface area of the spring clip in contact with the mounting shank.

The size of the gap will be primarily determined by the thickness of the aluminum oxide layer, however, surface irregularities on the smooth cylindrical surface and spring clip may also be a factor. In the illustrated embodiments of FIGS. 10 and 12, smooth cylindrical surfaces 66A, 66B are raw aluminum surfaces having an aluminum oxide layer disposed thereon with a thickness 108 of no more than 10 nm. In these embodiments, a stainless steel spring clip 70A having a longitudinal or axial length 72A of no more than 0.64 cm (0.25 inches) with a total surface area in contact with the mounting shank of no more than about 3.8 $cm^2$ (0.59 square inches) is used to communicate electrical signals of no more than 5V. In such embodiments, it may be desirable to account for potential surface irregularities by the upward adjustment of the contact surface area.

In the embodiment of FIGS. 1-9, smooth cylindrical surface 66 is an anodized surface having an aluminum oxide layer of disposed thereon with a thickness 108 at least 1775 nm. The stainless steel spring clip 70 used with this embodiment to communicate electrical signals having a voltage of no more than 5V has a longitudinal or axial length of no more than 2.54 cm (1 inch) and a total surface area in contact with the mounting shank of no more than about 12.9 $cm^2$ (2 square inches).

In each of these exemplary embodiments 60, 60A, 60B, the spring clip is mounted on the smooth cylindrical surface of the mounting shank with the spring clip biasingly engaging and encircling greater than half of an outer circumference of the smooth cylindrical surface and electrical signals having a voltage of no more than 5V are communicated by capacitive coupling between the mounting shank and the spring clip without conduction of electrical current between the mounting shank and the spring clip.

An axial length 72, 72A of spring clip 70, 70A and the axial length of the smooth cylindrical surface on which the spring clip is mounted are roughly equivalent. The exemplary mounting shanks 60, 60A, 60B are hollow tubes and flexible outlet conduit 28 extends therethrough. When used with a pullout wand, increasing the length of the mounting shank shortens the length by which the pullout wand can be pulled out by the same amount if the length of conduit 28 is not increased. The axial length of helical thread 68 on the mounting shank is generally determined by the anticipated thicknesses of the support structure. It is generally desirable to have a shorter cylindrical surface on which the spring clip is mounted to thereby avoid lengthening the mounting shaft.

In the exemplary embodiments, spring clips 70, 70A are formed by a conductive metal sheet of material and, more particularly, a stainless steel material. This sheet material defines a circumferential collar 74 that encircles a central axis 71 and fully encircles the smooth cylindrical surface of the mounting shank. Collar 74 also defines the surface area in contact with the smooth cylindrical surface.

Collar 74 has a first end portion 76 and an opposite second end portion 78. First end portion 76 defines a radially outwardly extending first grip 80 and second end portion 78 defines a radially outwardly extending second grip 82. A spade connector 56 is secured to one of the grips, e.g., first grip 80 of spring clip 70, to provide an electrical connection between control circuit 58 and the spring clip.

Circumferential collar 74 extends for more than 360 degrees about central axis 71 and defines an overlapping zone 84 between the first and second grips 80, 82 wherein both the first end portion 76 and the second end portion 78 are disposed. Spring clip 70 is moveable between a relaxed state (FIG. 7) in which the spring clip defines a minimum inner diameter 86A of the spring clip and a biased open state (FIG. 8) defining a maximum inner diameter 86B of the spring clip.

Figure 6:
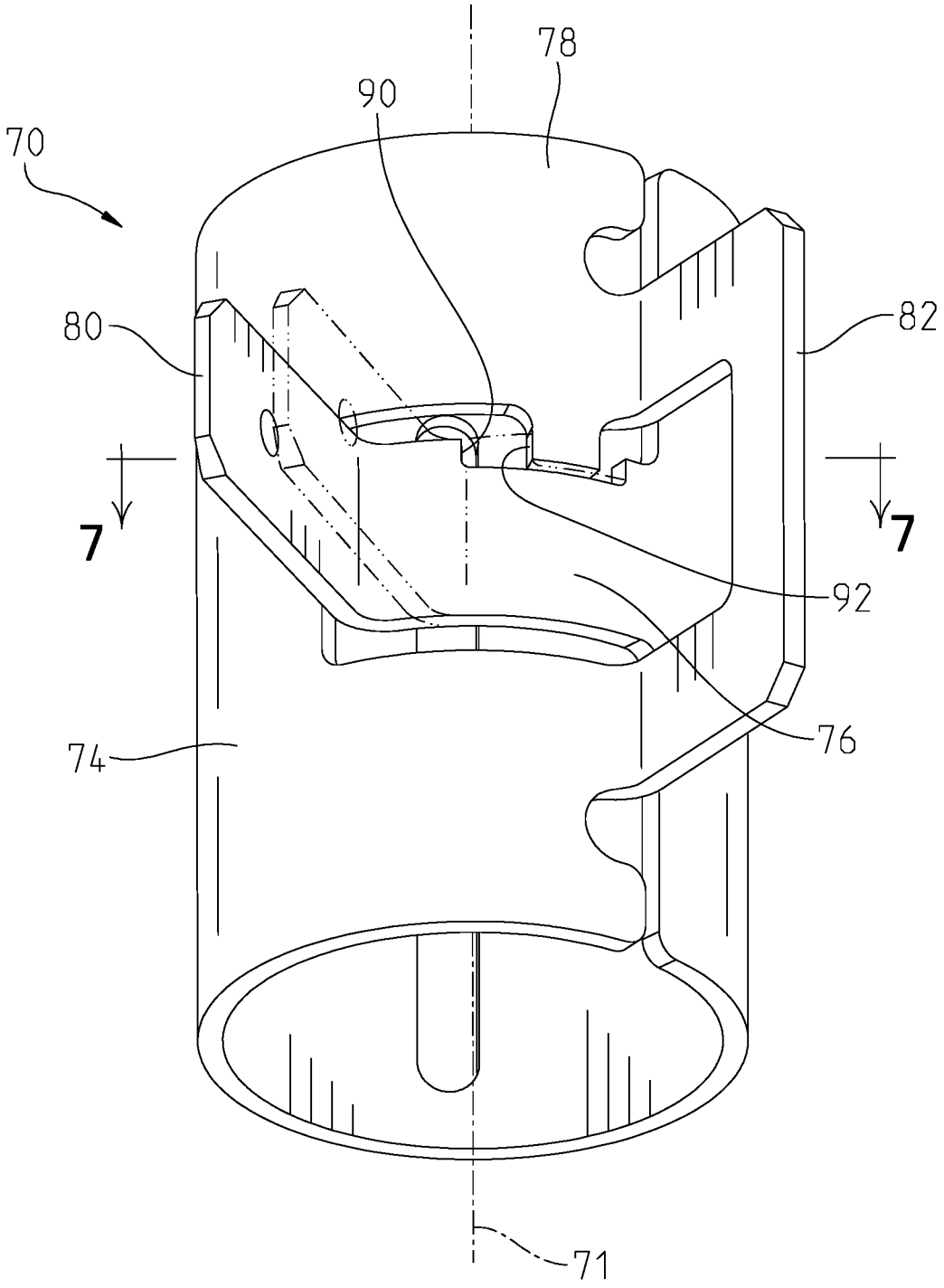
FIG. 6 is a perspective view of a spring clip.
Figure 7:
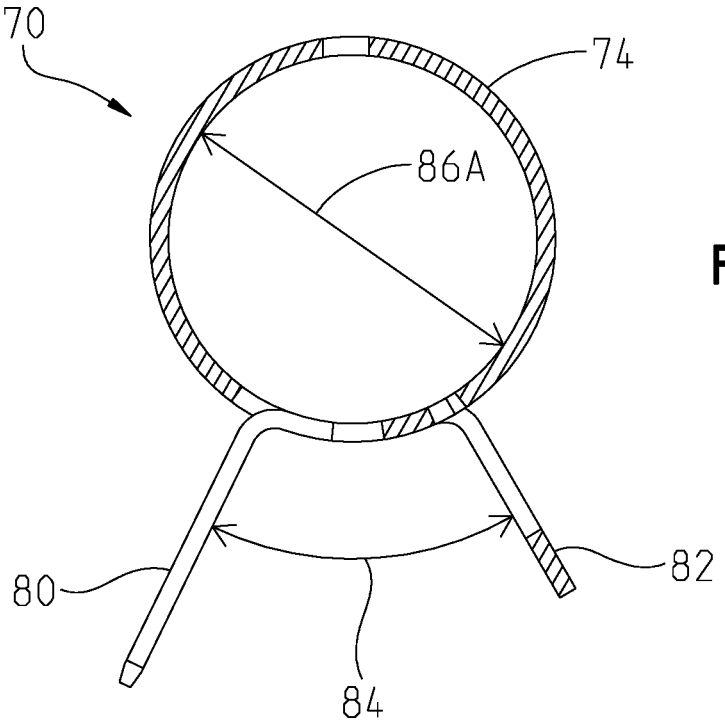
FIG. 7 is a cross sectional view taken along line 7-7 of FIG. 6 with the spring clip in an relaxed state.
Figure 8:
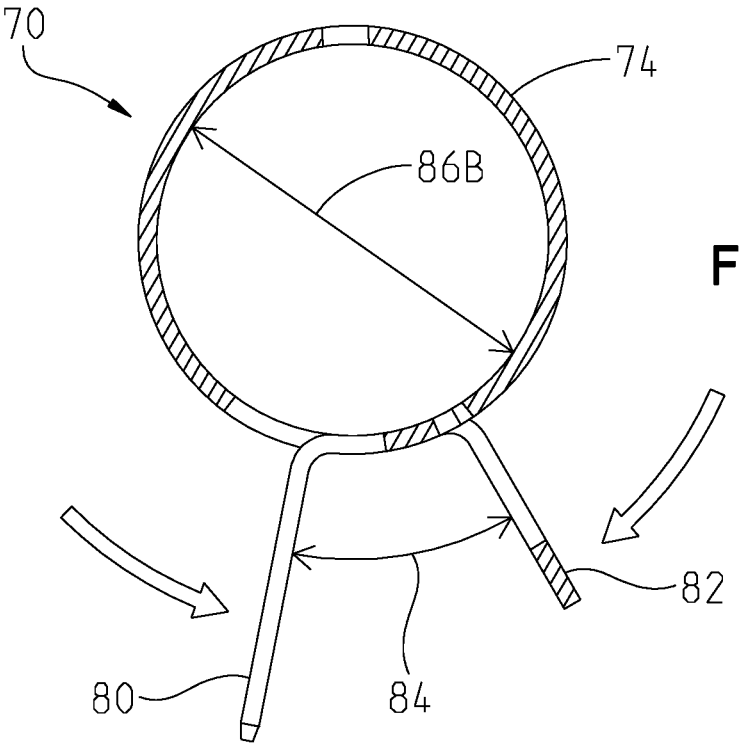
FIG. 8 is a cross sectional view taken along line 7-7 of FIG. 6 with the spring clip in a biased open state.
Figure 9:
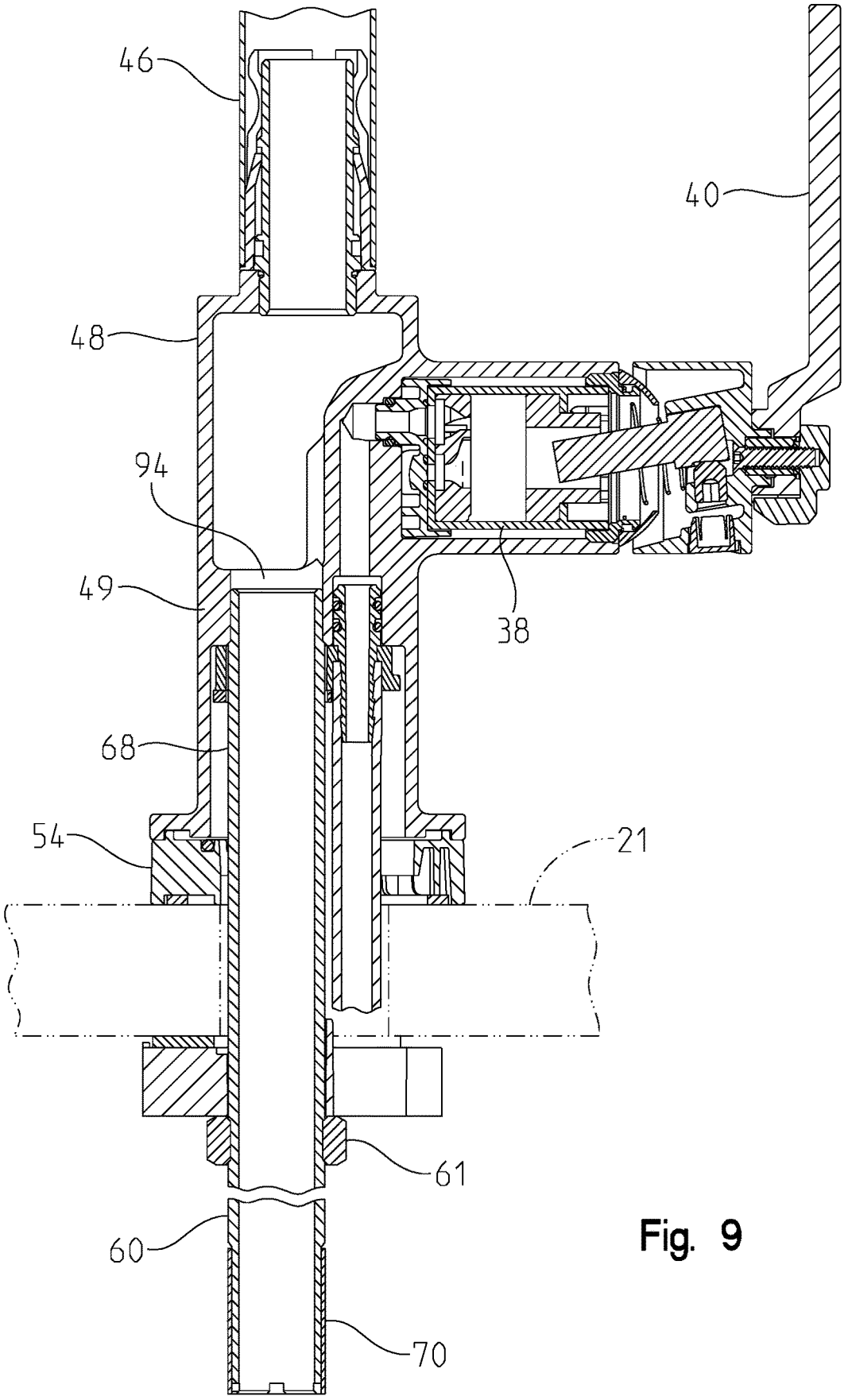
FIG. 9 is a cross sectional view of an electronic faucet assembly.

In the absence of any applied forces, spring clip 70 will assume its relaxed state. Biasing the first and second grips 80, 82 toward each other increases the inner diameter of the spring clip. This biasing force may be applied by an installer squeezing the grips together by hand or using pliers or other suitable tool. Squeezing the grips together will progressively enlarge the inner diameter of the spring clip until it reaches the biased open state corresponding to the maximum inner diameter 86B of the spring clip. In the illustrated embodiment, spring clip 70 has a first stop member 90 disposed on first end portion 76 and a second stop member 92 disposed on the second end portion 78. First and second stops 90, 92 engage each other and prevent further movement of the first and second grips 80, 82 toward each other when spring clip 70 is in its biased open state wherein the spring clip defines a maximum inner diameter 86B. In FIG. 6, the solid line depiction of stops 90, 92 show them in the relaxed state of spring clip 70 while the dashed line depictions of stops 90, 92 show them in an engaged position that limits further movement of grips 80, 82 toward each other.

To install spring clip 70, the grips 80, 82 are squeezed together and the spring clip 70 is slid onto smooth cylindrical surface 66. Grips 80, 82 are then released and spring clip 70 will return toward its relaxed state. Spring clip 70 is made out of a resiliently flexible material and will assume the smallest diameter it can between its biased open state and its relaxed state which will be the same as the outer diameter of the smooth cylindrical surface so long as its outer diameter is as large as the minimum inner diameter of the spring clip.

In the exemplary embodiments, the minimum and maximum inner diameters 86A, 86B of spring clip 70 are chosen so that spring clip 70 must be installed on the smooth cylindrical surface of the mounting shank. Outer diameter 67 defined by the smooth cylindrical surface 66 is at least as great as the minimum inner diameter 86A of the spring clip to ensure that spring clip 70 biasingly engages the smooth cylindrical surface. Exterior helical thread 68 defines an outer diameter 69 which is greater than the outer diameter 67 of the smooth cylindrical surface. The outer diameter 69 of the helical thread is greater than the maximum inner diameter 86B of the spring clip to prevent the spring clip from being installed on the helical thread as is typical in prior art connections. Spring clip 70A has a smaller axial length than spring clip 70 but functions in the same manner as that described above for spring clip 70.

In the illustrated embodiments, faucet body 22 includes both a faucet hub 48 and a spout 46 with the faucet hub 48 being disposed between the mounting shank 60 and spout 46. The faucet hub has a body formed out of a conductive material, such as zinc, brass or a chrome plated polymer, wherein the proximal portion 62 of mounting shank 60 is directed engaged and secured to the body of the faucet hub 48 and spout 46 is supported on the faucet hub 48. In the illustrated embodiments, the faucet hub communicates electrical signals between the circuit component disposed on the spout and the proximal portion of mounting shank. This can be accomplished by direct contact between the electrically conductive materials forming the faucet hub 48 and spout 46 or by establishing electrical communication through one or more intermediate parts.

Three different embodiments of mounting shank are shown in the figures. Mounting shank 60 includes an anodized helical thread 68 that extends to proximal end of mounting shank 60. In this embodiment, best seen in FIGS. 1, 3 and 9, the proximal end of mounting shank 60 is threaded into engagement with a threaded bore defined by the body 49 of faucet hub 48. Electrical signals are communicated across this threaded engagement. In this embodiment, the distal end of shank 60 may advantageously include two diametrically opposed slots which can be engaged by a tool to thereby facilitate the threaded engagement of the shank with the body 49 of the faucet hub.

Figure 10:
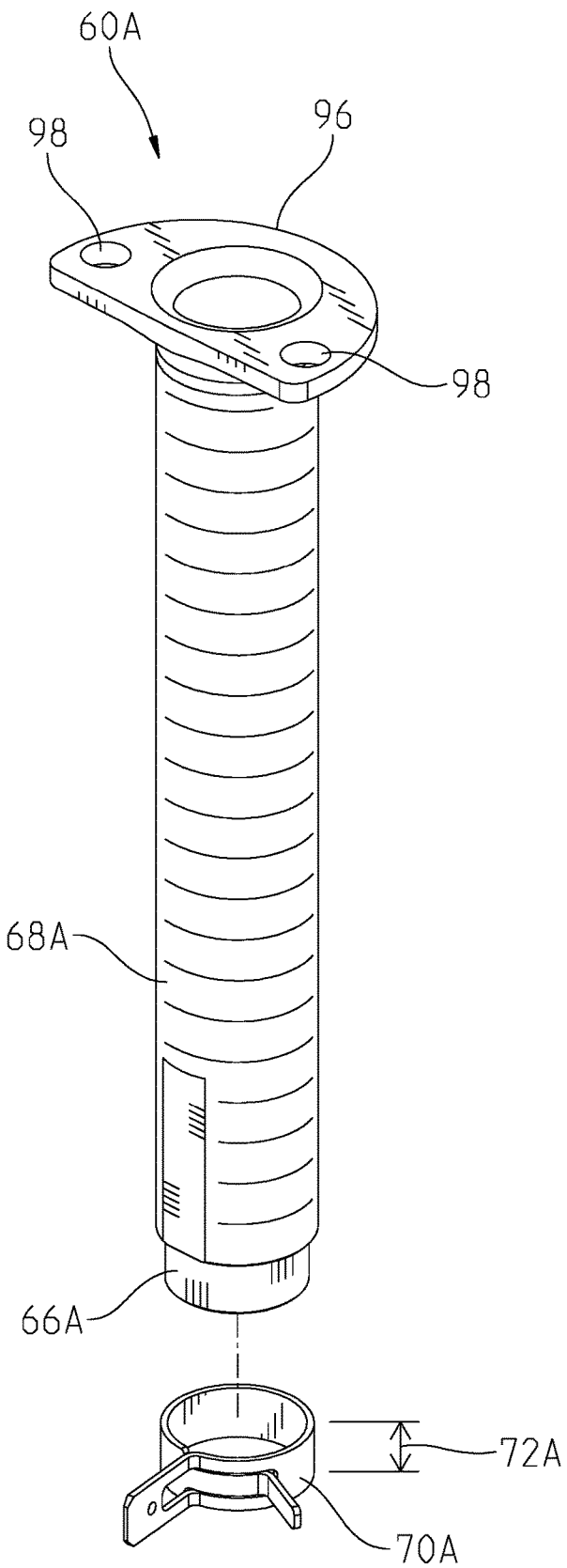
FIG. 10 is a perspective view of an alternative mounting shank and spring clip.
Figure 11:
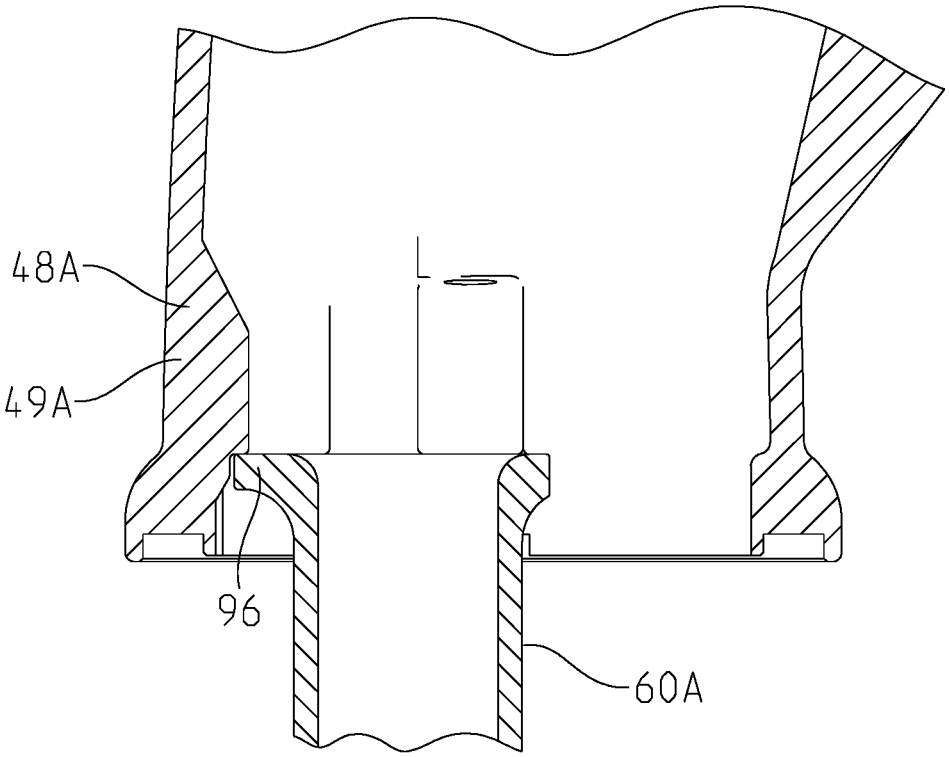
FIG. 11 is a cross sectional view showing the mounting shank of FIG. 10 mounted to a faucet hub.

The embodiment of FIGS. 10 and 11 includes a mounting shank 60A having a proximal portion that defines a mounting flange 96 having a pair of apertures 98. Threaded fasteners (not shown) are used to secure flange 96 at apertures 98 to body 49A of faucet hub 48A.

Figure 12:
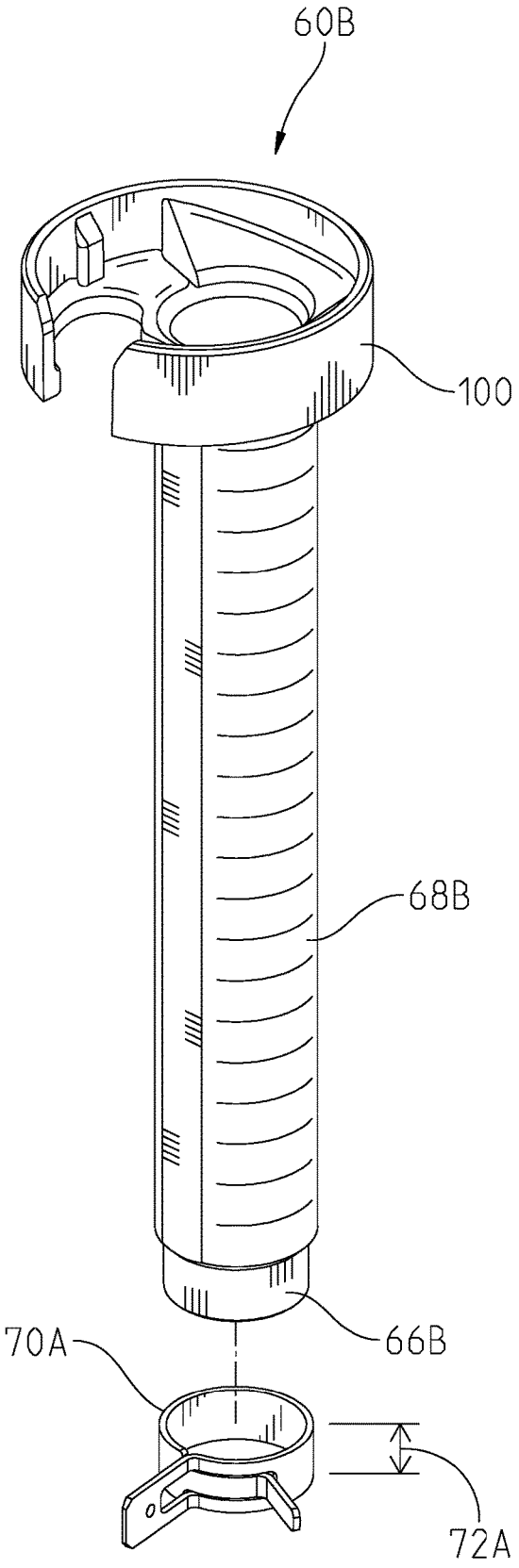
FIG. 12 is a perspective view of another mounting shank and spring clip.
Figure 13:
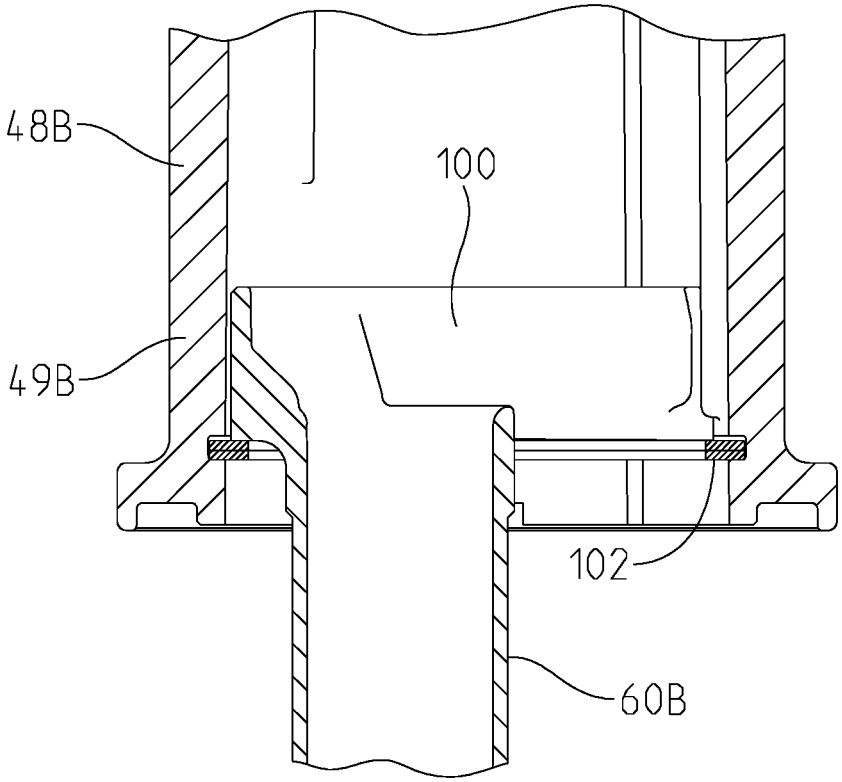
FIG. 13 is a cross sectional view showing the mounting shank of FIG. 12 mounted to a faucet hub.

The embodiment of FIGS. 12 and 13 includes a mounting shank 60B having a proximal portion that defines a circumferential collar 100 wherein collar 100 is engaged with the body 49B of faucet hub 48B. Snap rings 102 are used to retain collar 100 within faucet hub body 49B.

It is noted that when the illustrated mounting shanks have anodized aluminum surfaces, the anodized surface may be removed or penetrated during securement of the faucet hub body to the mounting shaft to provide direct contact between an electrically conductive material of the faucet hub body and the mounting shank. For example, threaded engagement between mounting shank 60 and hub body 49 may result in such direct contact to thereby provide electrical communication between the two parts by conducting an electrical current across the interface of the two parts. Alternatively, if the anodized surface is retained, the surface area of the proximal portion of the mounting shank that is in contact with the faucet hub body and separated only by the thickness of the aluminum oxide layer will be sufficiently great to allow for the communication of electrical signals by capacitive coupling.

Various other configurations may also be used to secure the mounting shank to the faucet body and/or provide for the communication of electrical signals to the proximal portion of the mounting shank. For example, the mounting shank might be formed integrally with the faucet body.

While this invention has been described as having an exemplary design, the present invention may be further modified within the spirit and scope of this disclosure. This application is therefore intended to cover any variations, uses, or adaptations of the invention using its general principles.

What is claimed is:

1. An electronic faucet assembly configured to be mounted on a support structure and coupled to a fluid supply, the electronic faucet assembly comprising:

a faucet body;

a fluid passageway supported by the faucet body;

a mounting shank mechanically coupled to the faucet body and configured to extend through the support structure, the mounting shank having a proximal portion disposed proximate the faucet body and a distal portion spaced from the proximal portion;

at least one electrically controlled valve disposed in a fluid line between the fluid supply and the fluid passageway;

a control circuit in communication with the at least one electrically controlled valve, the control circuit including a controller configured to control operation of the at least one electrically controlled valve;

a circuit component in electrical communication with the proximal portion of the mounting shank;

a spring clip mounted on the distal portion of the mounting shank with the spring clip being in electrical communication with the control circuit; and wherein the mounting shank is formed of an aluminum material and the distal portion of the mounting shank includes an exterior surface defining a smooth cylindrical surface and wherein the spring clip is mounted on the smooth cylindrical surface of the mounting shank with the spring clip biasingly engaging and encircling greater than half of an outer circumference of the smooth cylindrical surface such that electrical signals communicated between the circuit component and the control circuit are communicated through the mounting shank and the spring clip.

2. The electronic faucet assembly of claim 1 wherein the smooth cylindrical surface is raw aluminum surface.

3. The electronic faucet assembly of claim 2 wherein the mounting shank defines an exterior helical thread between the distal and proximal portions of the mounting shank, the exterior helical thread having an anodized surface.

4. The electronic faucet assembly of claim 1 wherein the spring clip fully encircles the smooth cylindrical surface of the mounting shank and the circuit component is a sensing element of a capacitive sensor.

5. The electronic faucet assembly of claim 4 wherein the faucet body has an exposed surface defined by an electrically conductive material and the exposed surface forms the sensing element.

6. The electronic faucet assembly of claim 5 wherein control circuit further includes capacitive sensor wherein the capacitive sensor is configured to detect when a person touches the exposed surface.

7. The electronic faucet assembly of claim 6 wherein the electrical signals are communicated between the mounting shank and the spring clip by capacitive coupling without conduction of electrical current between the mounting shank and the spring clip.

8. The electronic faucet assembly of claim 7 wherein the control circuit applies an electrical potential to the sensing element through the spring clip and mounting shank and the capacitive sensor monitors the electrical signals conveyed between the spring clip and mounting shank to detect touching of the sensing element by a user and wherein the electrical potential applied to the sensing element is no greater than 5V.

9. The electronic faucet assembly of claim 8 wherein the smooth cylindrical surface is a raw aluminum surface having an aluminum oxide layer disposed thereon with a thickness of no more than 10 nm and wherein the spring clip is formed of stainless steel and has a longitudinal length of no more than 0.64 cm.

10. The electronic faucet assembly of claim 8 wherein the smooth cylindrical surface is an anodized surface having an aluminum oxide layer of at least 1775 nm and the spring clip is formed of stainless steel and has a longitudinal length of no more than 2.54 cm.

11. The electronic faucet assembly of claim 1 wherein the smooth cylindrical surface is a raw aluminum surface having an aluminum oxide layer disposed thereon with a thickness of no more than 10 nm and wherein the electrical signals have a voltage of no more than 5V and are communicated between the mounting shank and the spring clip by capacitive coupling without conduction of electrical current between the mounting shank and the spring clip.

12. The electronic faucet assembly of claim 8 wherein the smooth cylindrical surface is an anodized surface having an aluminum oxide layer of at least 1775 nm and wherein the electrical signals have a voltage of no more than 5V and are communicated between the mounting shank and the spring clip by capacitive coupling without conduction of electrical current between the mounting shank and the spring clip.

13. The electronic faucet assembly of claim 1 wherein the spring clip fully encircles the smooth cylindrical surface of the mounting shank and the faucet body comprises a faucet hub and a spout, the faucet hub disposed between the mounting shank and the spout, the faucet hub including a body formed out of a conductive metal wherein the proximal portion of the mounting shank is directly engaged and secured to the body of the faucet hub and the spout is supported on the faucet hub and wherein the body of the faucet hub communicates the electrical signals between the circuit component and the proximal portion of the mounting shank.

14. The electronic faucet assembly of claim 13 wherein the mounted shank defines an exterior helical thread having an anodized surface, the helical thread being in threaded engagement with the body of the faucet hub and wherein the electrical signals are communicated from the body of the faucet hub to the mounting shank across the threaded engagement.

15. The electronic faucet assembly of claim 13 wherein the proximal portion of the mounting shank defines a mounting flange and wherein the body of the faucet hub is secured to the mounting flange.

16. The electronic faucet assembly of claim 13 wherein the proximal portion of the mounting shank defines a circumferential collar wherein the collar is engaged with the body of the faucet hub.

17. The electronic faucet assembly of claim 1 wherein the spring clip fully encircles the smooth cylindrical surface of the mounting shank and the mounting shank defines an exterior helical thread between the proximal portion of the mounting shank and the smooth cylindrical surface, the exterior helical thread defining a first diameter and the smooth cylindrical surface defining a second diameter smaller than the first diameter and wherein the spring clip is movable between a relaxed state in which spring clip defines a minimum inner diameter of the spring clip and a biased open state upon the application of a force to the spring clip, the biased open state defining a maximum inner diameter of the spring clip and wherein the second diameter defined by the smooth cylindrical surface is at least as great as the minimum inner diameter of the spring clip and the first diameter of the helical thread is greater than the maximum inner diameter of the spring clip.

18. The electronic faucet assembly of claim 17 wherein the smooth cylindrical surface is a raw aluminum surface and the exterior helical thread has an anodized surface.

19. An electronic faucet assembly configured to be mounted on a support structure and coupled to a fluid supply, the electronic faucet assembly comprising:

a faucet body;

a fluid passageway supported by the faucet body;

a mounting shank mechanically coupled to the faucet body and configured to extend through the support structure, the mounting shank having a proximal portion disposed proximate the faucet body and a distal portion spaced from the proximal portion;

at least one electrically controlled valve disposed in a fluid line between the fluid supply and the fluid passageway;

a control circuit in communication with the at least one electrically controlled valve, the control circuit including a controller configured to control operation of the at least one electrically controlled valve;

a circuit component in electrical communication with the proximal portion of the mounting shank;

a spring clip mounted on the distal portion of the mounting shank, the spring clip being in electrical communication with the control circuit; and wherein the mounting shank is formed of an electrically conductive metal material and the distal portion of the mounting shank includes an exterior surface defining a smooth cylindrical surface and wherein a layer of non-conductive material covers the smooth cylindrical surface and wherein the spring clip is mounted on the smooth cylindrical surface of the mounting shank with the spring clip biasingly engaging and encircling greater than half of an outer circumference of the smooth cylindrical surface such that electrical signals communicated between the circuit component and the control circuit are communicated through the mounting shank and the spring clip and wherein the communication of the electrical signals between the distal portion of the mounting shank and the spring clip is by capacitive coupling without conduction of electrical current between the mounting shank and the spring clip.

20. The electronic faucet assembly of claim 19 wherein the electrically conductive metal material is an aluminum material and the non-conductive material is aluminum oxide.

21. The electronic faucet assembly of claim 20 wherein the smooth cylindrical surface is raw aluminum and the aluminum oxide layer has a thickness of no more than 10 nm and wherein the voltage of the electrical signals is no greater than 5V.

22. The electronic faucet assembly of claim 20 wherein the smooth cylindrical surface is an anodized surface and the aluminum oxide layer is at least as great as 1775 nm and wherein the voltage of the electrical signals is no greater than 5V.

23. The electronic faucet assembly of claim 19 wherein the mounting shank defines an exterior helical thread between the distal and proximal portions of the mounting shank, the exterior helical thread defining a first diameter and the smooth cylindrical surface defining a second diameter smaller than the first diameter and wherein the spring clip is movable between a relaxed state in which spring clip defines a minimum inner diameter of the spring clip and a biased open state upon the application of a force to the spring clip, the biased open state defining a maximum inner diameter of the spring clip and wherein the second diameter defined by the smooth cylindrical surface is at least as great as the minimum inner diameter of the spring clip and the first diameter of the helical thread is greater than the maximum inner diameter of the spring clip.

24. An electrical connection assembly for an electronic faucet assembly having a faucet body configured to be mounted on a support structure and a control circuit with a circuit component, the electrical connection comprising:

a mounting shank mechanically coupled to the faucet body and configured to extend through the support structure, the mounting shank having a proximal portion disposed proximate the faucet body and a distal portion spaced from the proximal portion; and a spring clip adapted to be in electrical communication with the control circuit, the spring clip being formed by a conductive metal sheet material which defines a circumferential collar that encircles a central axis, the collar having a first end portion and an opposite second end portion, the first end portion defining a radially outwardly extending first grip and the second end portion defining a radially outwardly extending second grip, the circumferential collar extending for greater than 360 degrees about the central axis to thereby define an overlapping zone between the first and second grips wherein both the first end portion and the second end portion are disposed, and wherein, in a relaxed state, the spring clip defines a minimum inner diameter of the spring clip and wherein biasing the first and second grips toward each other increases the inner diameter of the spring clip, the first end portion defining a first stop member and the second end portion defining a second stop member engagement of the first and second stop members preventing further movement of the first and second grips toward each other and defining a biased open state wherein the spring clip defines a maximum inner diameter of the spring clip;

wherein the mounting shank is formed of an electrically conductive metal material and the distal portion of the mounting shank includes an exterior surface defining a smooth cylindrical surface and wherein the spring clip is mounted on the smooth cylindrical surface of the mounting shank with the spring clip biasingly engaging and encircling an outer circumference of the smooth cylindrical surface such that electrical signals communicated between the circuit component and the control circuit are communicated through the mounting shank and the spring clip; and wherein the mounting shank defines a first outer diameter between the proximal portion of the mounting shank and the smooth cylindrical surface, the smooth cylindrical portion defining a second diameter smaller than the first diameter and wherein the second diameter is at least as great as the minimum inner diameter of the spring clip and the first diameter is greater than the maximum inner diameter of the spring clip.

25. The electrical connection assembly of claim 24 wherein the mounting shank defines an exterior helical thread between the proximal portion and the smooth cylindrical surface, the exterior helical thread defining the first outer diameter.

26. The electrical connection assembly of claim 24 wherein the mounting shank is formed of an aluminum material and the spring clip is formed of a stainless steel material.

27. The electrical connection assembly of claim 24 wherein the mounting shank is formed of an aluminum material and the smooth cylindrical surface is a raw aluminum surface.

28. The electrical connection assembly of claim 27 wherein the spring clip has an axial length of no more than 0.64 cm and a total surface area in contact with the mounting shank of no more than 3.8 $cm^2$, the raw aluminum surface of the smooth cylindrical surface has an aluminum oxide layer disposed thereon with a thickness of no more than 10 nm, the electrical signals have a voltage of no more than 5V and the electrical signals are communicated between the mounting shank and the spring clip by capacitive coupling without conduction of electrical current between the mounting shank and the spring clip.

29. The electrical connection assembly of claim 24 wherein the mounting shank is formed of an aluminum material and the smooth cylindrical surface is an anodized aluminum surface.

30. The electrical connection assembly of claim 29 wherein the spring clip has an axial length of no more than 2.54 cm and a total surface area in contact with the mounting shank of no more than 12.9 $cm^2$, the anodized aluminum surface of the smooth cylindrical surface has an aluminum oxide layer disposed thereon with a thickness of at least 1775 nm, the electrical signals have a voltage of no more than 5V and the electrical signals are communicated between the mounting shank and the spring clip by capacitive coupling without conduction of electrical current between the mounting shank and the spring clip.

* * * * *